US012123606B2

(12) United States Patent
Hong et al.

(10) Patent No.: US 12,123,606 B2
(45) Date of Patent: Oct. 22, 2024

(54) HEAT PUMP AND METHOD FOR OPERATING A HEAT PUMP

(71) Applicant: LG ELECTRONICS INC., Seoul (KR)

(72) Inventors: Seongho Hong, Seoul (KR); Eunjun Cho, Seoul (KR); Hojin Seo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 250 days.

(21) Appl. No.: 17/801,956

(22) PCT Filed: Feb. 24, 2021

(86) PCT No.: PCT/KR2021/002313
§ 371 (c)(1),
(2) Date: Aug. 24, 2022

(87) PCT Pub. No.: WO2021/172866
PCT Pub. Date: Sep. 2, 2021

(65) Prior Publication Data

US 2023/0077481 A1 Mar. 16, 2023

(30) Foreign Application Priority Data

Feb. 25, 2020 (KR) ..... 10-2020-0023200

(51) Int. Cl.
*F24F 11/36* (2018.01)

(52) U.S. Cl.
CPC ..... *F24F 11/36* (2018.01)

(58) Field of Classification Search
CPC . F24F 11/36; F25B 2500/22; F25B 2500/221; F25B 2500/222
See application file for complete search history.

(56) References Cited

U.S. PATENT DOCUMENTS

2011/0296860 A1 12/2011 Honda
2012/0272672 A1* 11/2012 Morimoto ..... F25B 41/20 62/126

(Continued)

FOREIGN PATENT DOCUMENTS

CN 201392052 1/2010
CN 102840726 12/2012

(Continued)

OTHER PUBLICATIONS

International Search Report dated Jun. 21, 2021 issued in Application No. PCT/KR2021/002313.

(Continued)

*Primary Examiner* — David J Teitelbaum
(74) *Attorney, Agent, or Firm* — KED & ASSOCIATES, LLP

(57) ABSTRACT

A heat pump including a housing configured to be disposed outdoors; a compressor that compresses a refrigerant; a fluid refrigerant heat exchanger configured to perform heat exchange between the refrigerant and a fluid; an outdoor heat exchanger configured to perform heat exchange between the refrigerant and outdoor air; a pressure sensor configured to detect a pressure of the refrigerant flowing between the compressor and the fluid refrigerant heat exchanger; a first shut-off valve disposed in a pipe connected to a discharge of the compressor; a second shut-off valve disposed between the outdoor heat exchanger and the compressor; and a controller configured to: determine whether the refrigerant leaks, control the first shut-off valve to be closed, when the refrigerant leaks, and control the second shutoff valve to be closed, when the pressure sensed by the pressure sensor is less than a predetermined reference pressure.

20 Claims, 5 Drawing Sheets

(56) References Cited

U.S. PATENT DOCUMENTS

| | | | | |
|---|---|---|---|---|
| 2013/0192283 | A1* | 8/2013 | Yamashita | F24F 3/08 62/126 |
| 2014/0123685 | A1* | 5/2014 | Kim | F25B 41/24 62/56 |
| 2014/0196483 | A1* | 7/2014 | Okazaki | F25B 25/005 62/126 |
| 2019/0338993 | A1 | 11/2019 | Aikawa et al. | |
| 2019/0346191 | A1* | 11/2019 | Minamisako | F25B 41/335 |

FOREIGN PATENT DOCUMENTS

| | | |
|---|---|---|
| CN | 103807921 | 5/2014 |
| CN | 106196720 | 12/2016 |
| CN | 104567158 | 2/2017 |
| EP | 3012551 | 4/2016 |
| EP | 3 569 956 | 11/2019 |
| EP | 3 598 037 | 1/2020 |
| JP | 2008-170058 | 7/2008 |
| JP | 2011-21838 | 2/2011 |
| JP | 2015-1356 | 1/2015 |
| JP | 2016-38107 | 3/2016 |
| JP | 2016-125673 | 7/2016 |
| JP | 2019-95156 | 6/2019 |
| JP | 2019-203620 | 11/2019 |
| KR | 10-2015-0019516 | 2/2015 |
| KR | 10-1917941 | 1/2019 |
| WO | WO 2018/225257 | 12/2018 |

OTHER PUBLICATIONS

Japanese Office Action dated Nov. 7, 2023 in Japanese Application No. 2022-550955.

Chinese Office Action dated Apr. 12, 2023 issued in Application No. 202180016959.2.

European Search Report issued in Application No. 21760996.5 dated Mar. 1, 2024.

* cited by examiner

[Fig. 2]
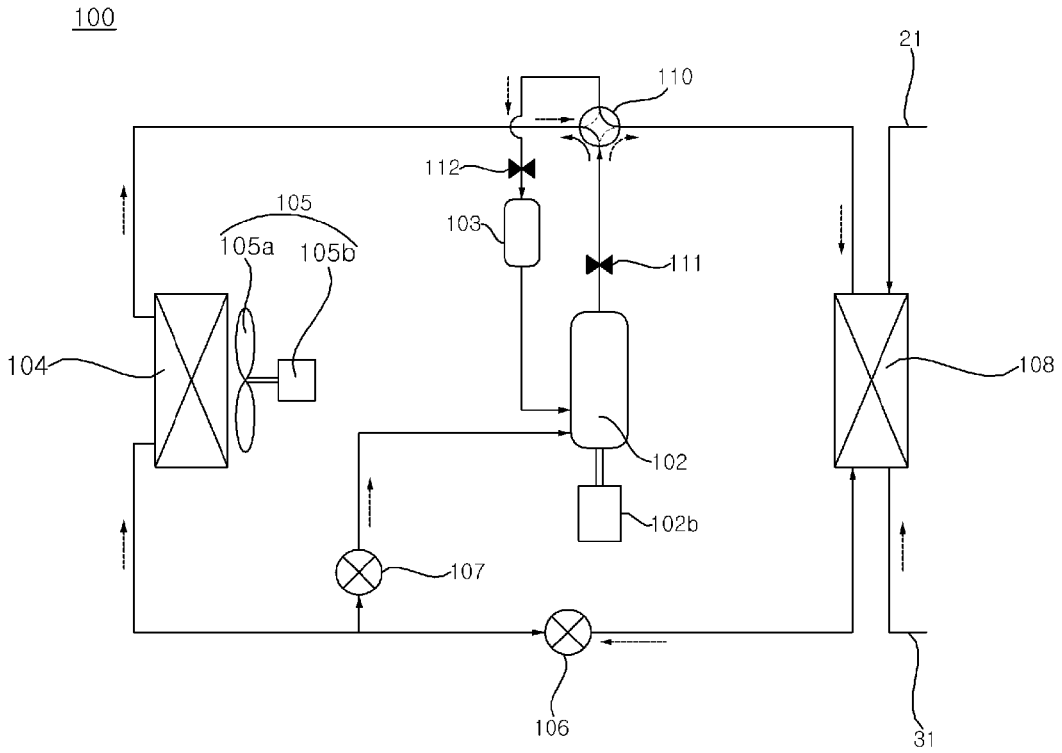

[Fig. 3]
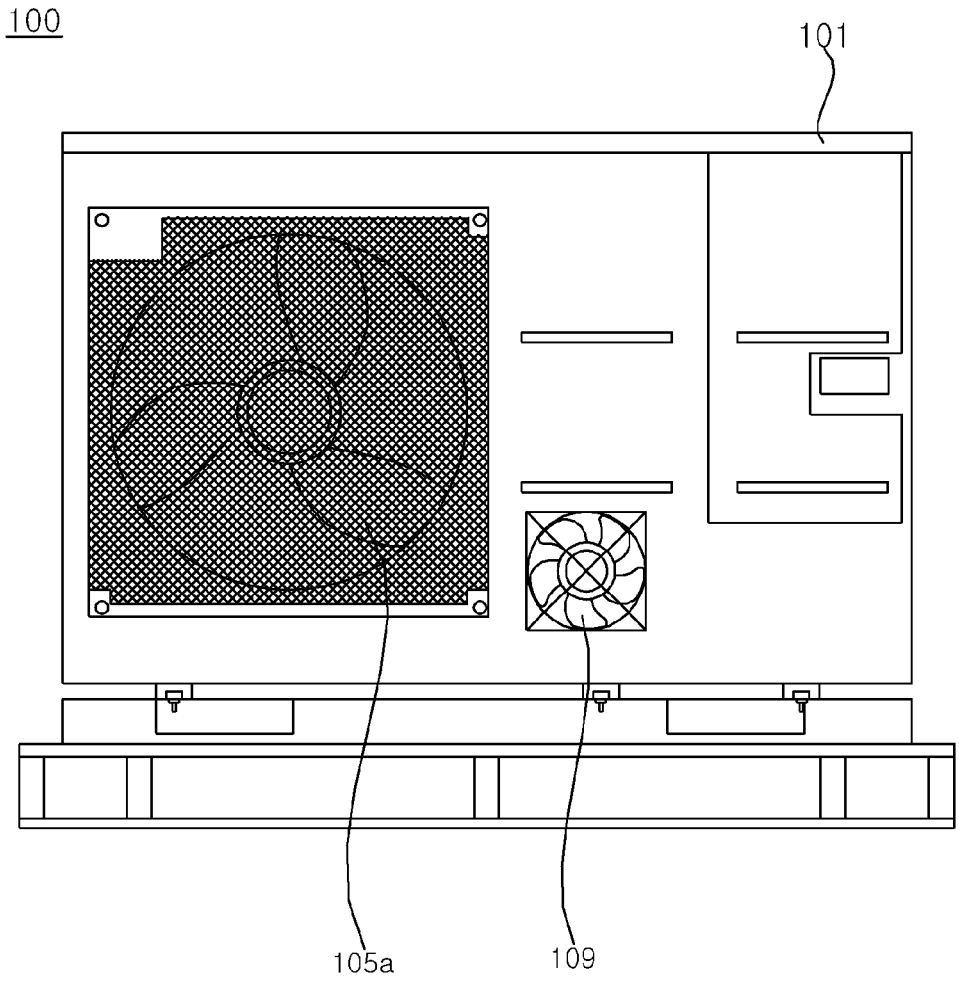

[Fig. 4]
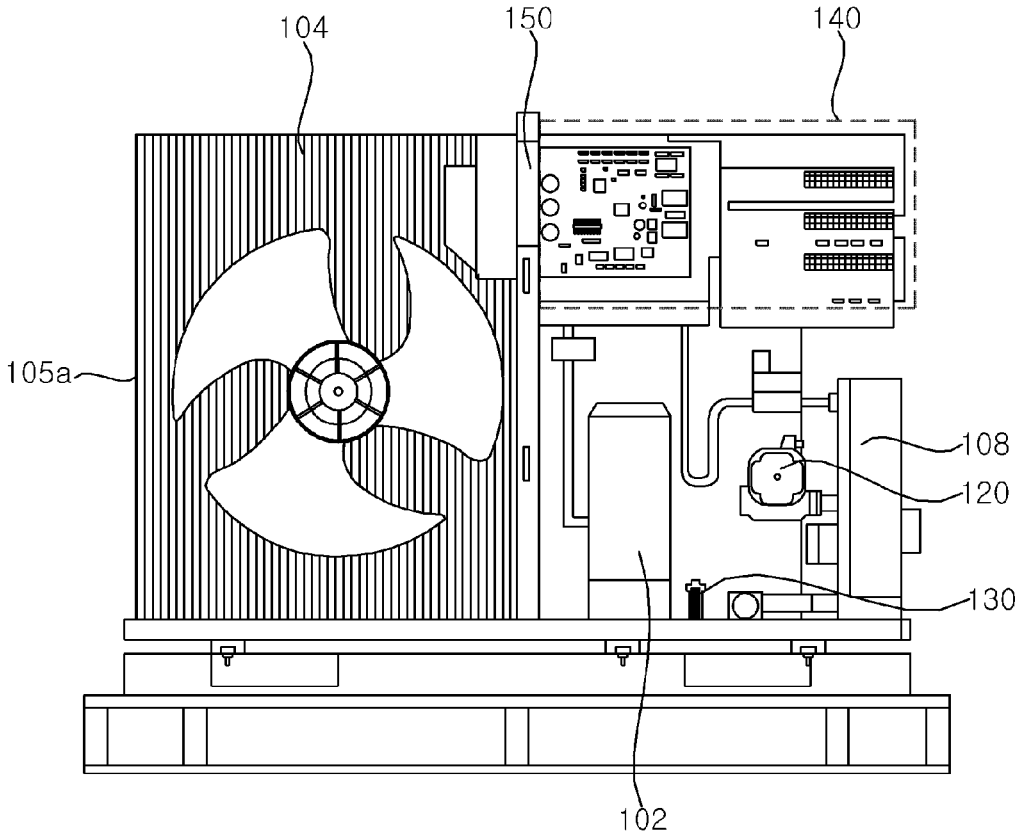
[Fig. 5]
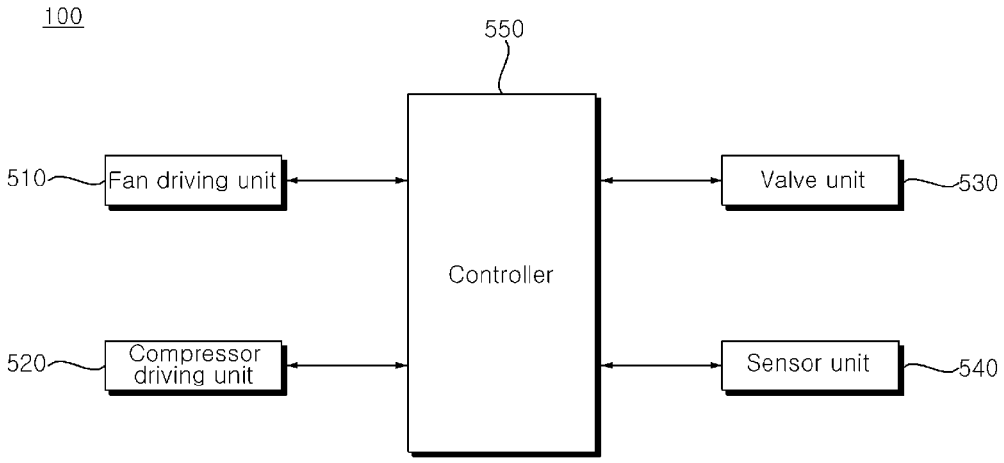

[Fig. 6]
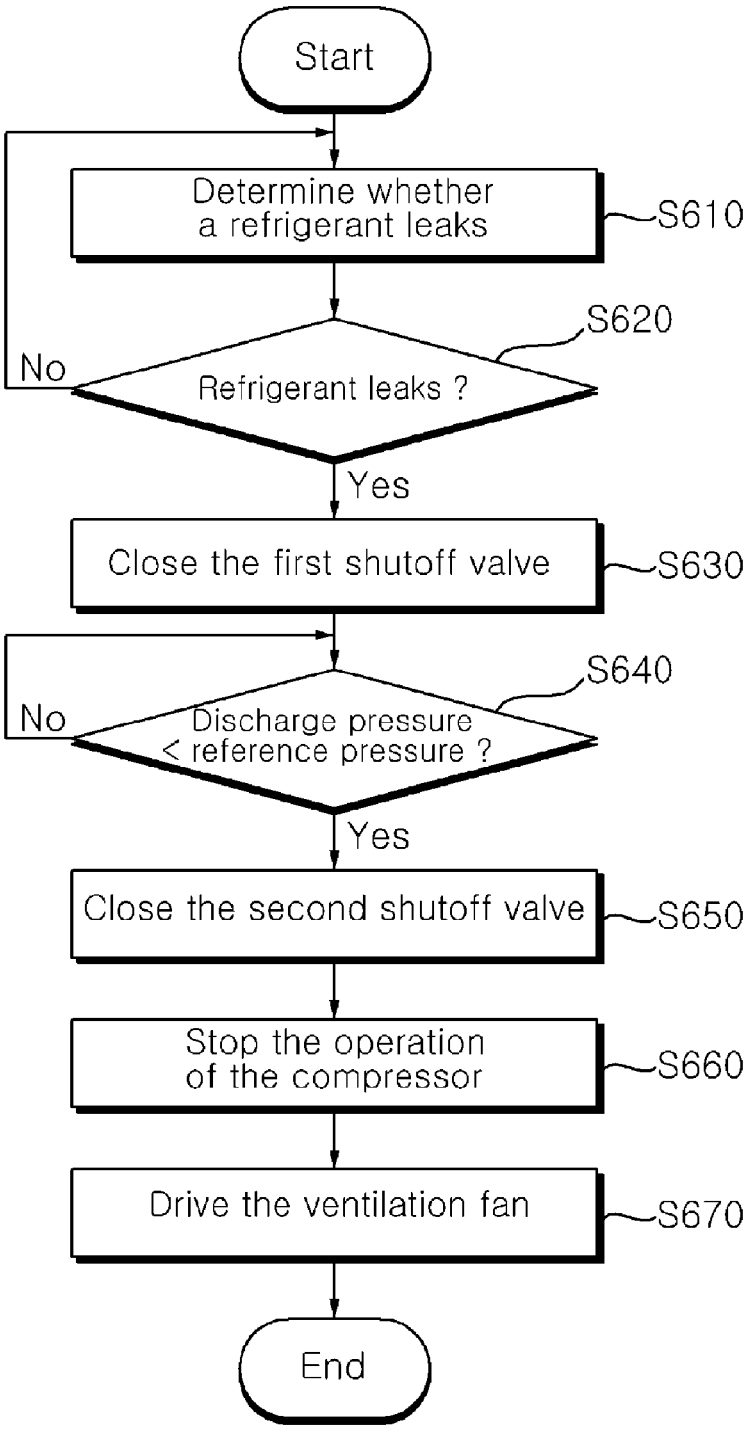

HEAT PUMP AND METHOD FOR OPERATING A HEAT PUMP

CROSS-REFERENCE TO RELATED PATENT APPLICATIONS

This application is a U.S. National Stage Application under 35 U.S.C. § 371 of PCT Application No. PCT/KR2021/002313, filed Feb. 24, 2021, which claims priority to Korean Patent Application No. 10-2020-0023200, filed Feb. 25, 2020, whose entire disclosures are hereby incorporated by reference.

TECHNICAL FIELD

The present disclosure relates to a heat pump and an operation method thereof, and more particularly, to a heat pump capable of determining whether a refrigerant is leaked, and an operation method thereof.

BACKGROUND ART

The heat pump refers to a device that transmits a low-temperature heat to a high temperature or transmits a high-temperature heat to a low temperature by using the heat generation or condensation heat of a refrigerant. In general, it may include an outdoor unit including a compressor, an outdoor heat exchanger, and the like, and an indoor unit including an indoor heat exchanger, and the like.

The heat pump may be used for heating to increase the temperature of the room, or for hot water supply providing hot water to users, by heating water through heat exchange of refrigerant, thereby replacing the use of fossil fuels.

Conventionally, a chlorofluorocarbon (CFC)-based refrigerant known as freon gas was widely used, but as it was found to be the cause of destroying the ozone layer existing in the atmosphere, the use of chlorofluorocarbon-based refrigerants was prohibited, and various alternative refrigerants have been developed and used.

Meanwhile, among the alternative refrigerants, in the case of a refrigerant containing propane or isobutane as a main component, Ozone Depletion Potential (ODP) is 0, and the Global Warming Potential (GWP) is also low in comparison with other alternative refrigerants, so it is in the spotlight as an eco-friendly refrigerant. However, due to its high flammability, there is a high possibility of a fire when a refrigerant leaks. In addition, in general, if sufficient refrigerant is not circulated due to refrigerant leakage, there are also problems such as low heat exchange efficiency and damage to the compressor.

DISCLOSURE OF INVENTION

Technical Problem

The present disclosure has been made in view of the above problems, and provides a heat pump capable of accurately determining whether a refrigerant is leaked according to various methods, and an operation method thereof.

The present disclosure further provides a heat pump capable of controlling the operation of valves so that the refrigerant is not leaked any more when the refrigerant is leaked, and an operation method thereof.

The present disclosure further provides a heat pump capable of preventing the refrigerant from entering indoors when a refrigerant is leaked, and discharging the refrigerant to the outside, and an operation method thereof.

Solution to Problem

In accordance with an aspect of the present disclosure, a heat pump includes a compressor for compressing a refrigerant, a plurality of shut-off valves, and a controller, wherein the controller determines whether the refrigerant leaks, closes the first shut-off valve when the refrigerant leaks, and closes the second shutoff valve when a sensing value of the pressure sensor is less than a preset reference pressure.

The heat pump further includes: a housing, a water refrigerant heat exchanger for heat-exchanging the refrigerant and water, an outdoor heat exchanger for heat-exchanging the refrigerant and outdoor air, a pressure sensor detecting a pressure of the refrigerant flowing between the compressor and the water refrigerant heat exchanger, and a first shut-off valve is disposed in a pipe connected to a discharge part of the compressor, and a second shut-off valve id disposed between the outdoor heat exchanger and the compressor.

The heat pump further includes an outdoor fan disposed in one side of the outdoor heat exchanger; and a ventilation fan for discharging air inside the housing to the outside, and the controller stops an operation of the compressor and drives the ventilation fan, when the second shutoff valve is closed.

The outdoor fan of the heat pump is disposed in a first area of the housing, the ventilation fan is disposed in a second area of the housing, and the housing includes a partition wall separating the first area and the second area from each other.

The water refrigerant heat exchanger of the heat pump is disposed in the second area of the housing.

The heat pump further includes a first temperature sensor for sensing an outdoor temperature; and a second temperature sensor disposed in a second area of the housing, and the controller determines that the refrigerant leaks, when a sensing value of the second temperature sensor is lower than a sensing value of the first temperature sensor by a certain reference or more.

The ventilation fan and the second temperature sensor of the heat pump are disposed adjacent to a bottom surface of the housing.

A density of the refrigerant is greater than that of air.

The heat pump further includes an expansion valve for expanding the refrigerant; and a third temperature sensor for sensing a temperature of the refrigerant discharged from the compressor, and the controller determines that the refrigerant leaks, when a sensing value of the third temperature sensor is equal to or higher than a preset reference temperature for a certain time, in a state where opening degree of the expansion valve is a maximum opening degree.

The controller of the heat pump calculates a power consumption of the compressor, and determines that the refrigerant leaks, when an operating frequency of the compressor is higher than or equal to a certain frequency, and the power consumption of the compressor is less than a certain power consumption.

The heat pump further includes a fourth temperature sensor for sensing a temperature of the outdoor heat exchanger, and the controller determines that the refrigerant leaks, when a difference between the sensing value of the first temperature sensor and a sensing value of the fourth temperature sensor is less than a certain reference value.

In accordance with another aspect of the present disclosure, a method of operating a heat pump includes: determining whether a refrigerant leaks; closing a first shutoff valve disposed in a pipe connected to a discharge part of a compressor for compressing the refrigerant, when the refrigerant leaks; and closing a second shutoff valve disposed between an outdoor heat exchanger for heat-exchanging the refrigerant with outdoor air and the compressor, when a sensing value of a pressure sensor detecting a pressure of the refrigerant flowing between a water refrigerant heat exchanger for heat-exchanging the refrigerant with water and the compressor is less than a preset reference pressure.

Advantageous Effects of Invention

As described above, according to various embodiments of the present disclosure, it is possible to accurately determine whether the refrigerant leaks from various angles through various methods by using the sensing value of the internal temperature sensor, the sensing value of the discharge temperature sensor, the sensing value of the outdoor temperature sensor, the sensing value of the heat exchanger temperature sensor, the power consumption of the compressor, and the like.

In addition, according to various embodiments of the present disclosure, when the refrigerant leaks, the shut-off valves are closed so that the refrigerant does not leak any more, and the refrigerant can be discharged to the outdoors by driving the ventilation fan, thereby reducing the possibility of fire, and improving the safety and reliability of the product.

In addition, according to various embodiments of the present disclosure, even if the refrigerant leaks, it is possible to block refrigerant from entering the room, by disposing the water refrigerant heat exchanger in the outdoor unit so that the refrigerant circulates only inside the housing of the outdoor unit.

According to various embodiments of the present disclosure, it is possible to accurately determine whether a refrigerant leaks through various methods using sensors or the like.

In addition, according to various embodiments of the present disclosure, when the refrigerant leaks, the operation of valves is controlled so that the refrigerant does not leak anymore, and the refrigerant can be discharged to the outdoors by driving a ventilation fan, thereby reducing the possibility of fire and improving the safety and reliability of the product.

BRIEF DESCRIPTION OF DRAWINGS

The above and other objects, features and advantages of the present disclosure will be more apparent from the following detailed description in conjunction with the accompanying drawings, in which:

FIG. 2 is a configuration of an outdoor unit of FIG. 1;

FIG. 3 is an example of a front view of the outdoor unit of FIG. 1;

FIG. 4 is an example of an inner front view of the outdoor unit of FIG. 1;

FIG. 5 is a block diagram of a heat pump according to an embodiment of the present disclosure; and FIG. 6 is a flowchart illustrating a method of operating a heat pump according to an embodiment of the present disclosure.

BEST MODE FOR CARRYING OUT THE INVENTION

Figure 1:
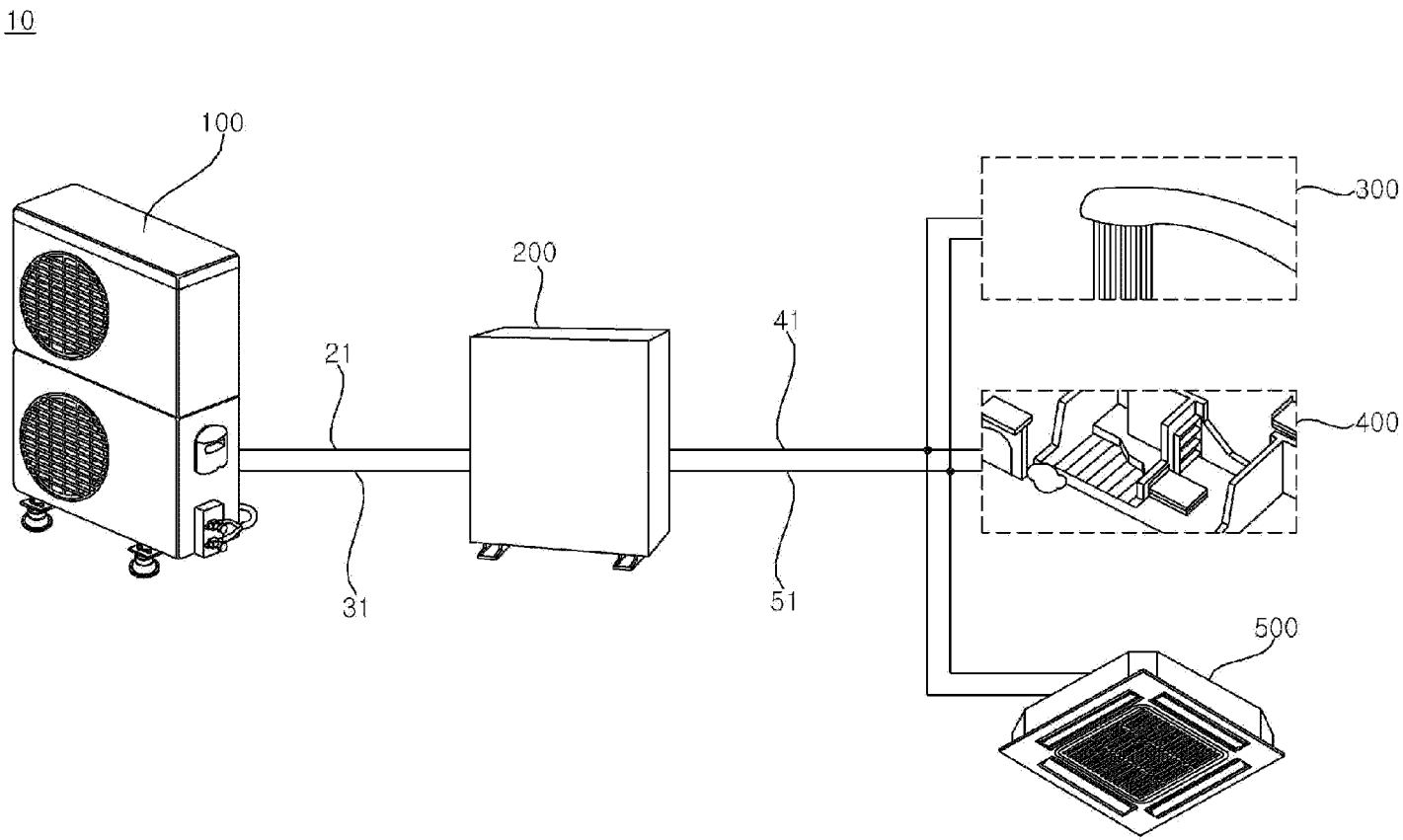
FIG. 1 is a schematic diagram of a system including a heat pump according to an embodiment of the present disclosure.

Hereinafter, the present disclosure will be described in detail with reference to the accompanying drawings. In order to clearly and briefly describe the present disclosure, components that are irrelevant to the description will be omitted in the drawings. The same reference numerals are used throughout the drawings to designate the same or similar components.

Terms "module" and "part" for elements used in the following description are given simply in view of the ease of the description, and do not carry any important meaning or role. Therefore, the "module" and the "part" may be used interchangeably.

It should be understood that the terms "comprise", "include", "have", etc. when used in this specification, specify the presence of stated features, integers, steps, operations, elements, components, or combinations of them but do not preclude the presence or addition of one or more other features, integers, steps, operations, elements, components, or combinations thereof.

It will be understood that, although the terms "first", "second", etc. may be used herein to describe various elements, these elements should not be limited by these terms. These terms are only used to distinguish one element from another element.

Unless otherwise defined, all terms including technical and scientific terms used herein have the same meaning as commonly understood by one of ordinary skill in the art to which the present disclosure belongs. Further, terms defined in a common dictionary will not be interpreted in an idealized or overly formal sense unless expressly so defined herein.

In the drawings, the thicknesses or the sizes of elements and graphs may be exaggerated, omitted or simplified to more clearly and conveniently illustrate the present disclosure.

FIG. 1 is a schematic diagram of a system including a heat pump according to an embodiment of the present disclosure, and FIG. 2 is a configuration diagram of an outdoor unit of FIG. 1.

Referring to FIGS. 1 and 2, a system 10 may include an outdoor unit 100, a distribution unit 200, a hot water supply unit 300, a heating unit 400, and/or an indoor unit 500. Here, the outdoor unit 100 and/or the distribution unit 200 may be included in a heat pump.

The outdoor unit 100 may be connected to the distribution unit 200 through a plurality of outdoor pipes 21 and 31. In this case, the outdoor unit 100 may be disposed outdoors, and the distribution unit 200 may be disposed indoors.

The outdoor unit 100 may receive water from the distribution unit 200 through any one of a plurality of outdoor pipes 21 and 31, and may deliver water to the distribution unit 200 through another of the plurality of outdoor pipes 21 and 31.

The outdoor unit 100 may include a compressor 102 that compresses the refrigerant, a compressor motor **102*b* for driving the compressor 102, an accumulator 103 that temporarily stores the gasified refrigerant to remove moisture and foreign matter, and then supplies a refrigerant having a constant pressure to the compressor 102, an outdoor heat exchanger 104 that serves to dissipate heat of the compressed refrigerant, an outdoor blower 105 including an outdoor fan 105*a* disposed in one side of the outdoor heat exchanger 104 to promote heat dissipation of refrigerant and an outdoor fan motor 105*b* for rotating the outdoor fan 105*a*, a main valves 106 (e.g., electronic expansion valves (EEV)) for expanding the condensed refrigerant, a water refrigerant heat exchanger 108 for heat-exchanging refrigerant and water, and/or a cooling/heating switching valve 110 that changes the flow path of the compressed refrigerant. In addition, the outdoor unit 100** may further include a plurality of sensors.

The refrigerant compressed by the compressor 102 of the outdoor unit 100 may have a higher density than air. The refrigerant may be a refrigerant containing propane, isobutene, or the like.

The outdoor unit 100 may operate according to the mode of the heat pump. For example, when the heat pump is set to a cooling mode, the outdoor unit 100 may operate to move the refrigerant compressed by the compressor 102 to the water refrigerant heat exchanger 108 through the outdoor heat exchanger 104. In addition, when the heat pump is set to a heating mode, the outdoor unit 100 may operate to move the refrigerant compressed by the compressor 102 to the outdoor heat exchanger 104 through the water refrigerant heat exchanger 108.

The outdoor unit 100 may include a sub valve 107 that adjusts the amount of refrigerant injected into the compressor 102. Here, the sub valve 107 may be an electronic expansion valve (EEV). When the refrigerant is injected into the compressor 102 through the sub-valve 107, it is possible to overcome the limitation of refrigerant suction which is limited by the density of the refrigerant sucked into the compressor 102 and the volume of a compression chamber of the compressor 102, thereby improving the compression capacity of the compressor 102. Through this, it is possible to increase the amount of refrigerant to be circulated, and to improve the performance of the cooling operation or heating operation of the heat pump.

Meanwhile, the outdoor unit 100 may additionally include a super-cooling heat exchanger (not shown) for heat exchange of the refrigerant expanded through the sub valve 107.

The outdoor unit 100 may include at least one shutoff valve 111, 112 that blocks movement of the refrigerant. At least one of the shut-off valves 111 and 112 may be a 2-way valve.

The first shutoff valve 111 may be disposed in a flow path through which the refrigerant compressed by the compressor 102 is discharged and moves to the outdoor heat exchanger 104 or the water refrigerant heat exchanger 108. For example, the first shutoff valve 111 may be disposed in a pipe connected to the discharge portion of the compressor 102 through which the compressed refrigerant is discharged.

The second shutoff valve 112 may be disposed in a flow path through which the refrigerant moves to the compressor 102 through the outdoor heat exchanger 104 and the water refrigerant heat exchanger 108. For example, the second shut-off valve 112 may be disposed in a pipe connecting the accumulator 103 and the cooling/heating switching valve 110.

The water refrigerant heat exchanger 108 may be connected to a plurality of outdoor pipes 21 and 31. Water supplied through any one of the plurality of outdoor pipes 21 and 31 may be discharged through the other one of the plurality of outdoor pipes 21 and 31 after heat exchange with the refrigerant.

The outdoor unit 100 may further include an outdoor pump (120 in FIG. 4) that pumps water circulating through the water refrigerant heat exchanger 108.

The distribution unit 200 may supply water to the outdoor unit 100 through any one of the plurality of outdoor pipes 21 and 31, and may be supplied with water from the outdoor unit 100 through the other one of the plurality of outdoor pipes 21 and 31. For example, when the heat pump is set to the heating mode, cold water may be supplied to the outdoor unit 100 and hot water may be supplied from the outdoor unit 100.

The distribution unit 200 may include a flow sensor (not shown) that detects a flow rate of water, a pump (not shown) that pumps water circulating through the distribution unit 200, an expansion tank (not shown), and an air vent valve (not shown) that discharges air.

Meanwhile, the distribution unit 200 may be connected to the hot water supply unit 300, the heating unit 400, and/or the indoor unit 500 through a plurality of indoor pipes 41 and 51.

The distribution unit 200 may distribute the water supplied from the outdoor unit 100 to at least one of the hot water supply unit 300, the heating unit 400, and the indoor unit 500, through a plurality of indoor pipes 41 and 51, and may supply the water delivered from at least one of the hot water supply unit 300, the heating unit 400, and the indoor unit 500 to the outdoor unit 100. To this end, the distribution unit 200 may further include a plurality of valves (not shown) for distributing water.

The heating unit 400 may include a heat dissipation pipe (not shown) connected to the plurality of indoor pipes 41 and 51. For example, the hot water supplied through any one of the plurality of indoor pipes 41 and 51 may move along the heat dissipation pipe to heat the indoor floor, and the cold water discharged after performing heat-exchange through the heat dissipation pipe may be delivered to the distribution unit 200 through the other one of the plurality of indoor pipes 41 and 51.

The indoor unit 500 is applicable to any of a stand type air conditioner, a wall-mounted type air conditioner, and a ceiling type air conditioner, but in the drawing, a ceiling type air conditioner is illustrated.

The indoor unit 500 may include an indoor heat exchanger (not shown), an indoor fan (not shown), and a plurality of sensors (not shown).

The indoor heat exchanger may heat-exchange air with cold water or hot water supplied from the distribution unit 200. The indoor fan may discharge the air heat-exchanged in the indoor heat exchanger into the room, through rotation.

FIG. 3 is an example of a front view of the outdoor unit of FIG. 1, and FIG. 4 is an example of an inner front view of the outdoor unit of FIG. 1.

Referring to FIGS. 3 and 4, one surface of the housing 101 of the outdoor unit 100 may include an area in which air heat exchanged by the outdoor heat exchanger 104 is discharged to the outside according to the rotation of the outdoor fan 105*a*.

Meanwhile, the outdoor unit 100 may further include a ventilation fan 109 that discharges air inside the housing 101 to the outside according to rotation. In this case, the ventilation fan 109 may be disposed in one surface of the housing 101 and exposed to the outside.

The ventilation fan 109 may include an impeller. The ventilation fan 109 may further include a filter (not shown) that blocks foreign matter such as dust flowing into the housing 101 from the outside.

The ventilation fan 109 may be disposed at a lower end adjacent to the bottom surface of the housing 101.

Meanwhile, the housing 101 may include a partition wall 150 that separates a first area in which the outdoor heat exchanger 104 and the outdoor fan 105*a* are disposed, and a second area in which the compressor 102, the water refrigerant heat exchanger 108, the outdoor pump 120, the control circuit module 140, and the like are disposed, from each other, and above mentioned two areas may be spatially separated from each other by the partition wall 150. The ventilation fan 109 may be disposed in correspondence with the second area so as to discharge the air inside the second area to the outside.

The outdoor unit 100 may further include an internal temperature sensor 130 that detects the temperature inside the housing 101. The internal temperature sensor 130 may be disposed in a lower end adjacent to the bottom surface of the second area of the housing 101.

FIG. 5 is a block diagram of a heat pump according to an embodiment of the present disclosure.

Referring to FIG. 5, the heat pump may include a fan driving unit 510, a compressor driving unit 520, a valve unit 530, a sensor unit 540, and/or a controller 550.

The fan driving unit 510 may drive at least one fan provided in the heat pump. For example, the fan driving unit 510 may drive the outdoor fan 105*a* and/or the ventilation fan 109.

The fan driving unit 510 may include a rectifier (not shown) that rectifies AC power into DC power and outputs the rectified AC power, a DC terminal capacitor that stores a pulsating voltage from the rectifier, an inverter (not shown) that has a plurality of switching elements and converts a smoothed DC power to a three-phase AC power having a certain frequency and outputs the three-phase AC power, and/or a motor (not shown) for driving a fan according to the three-phase AC power output from the inverter.

The fan driving unit 510 may have separate configurations for driving the outdoor fan 105*a* and the ventilation fan 109, respectively. For example, the fan driving unit 510 may include an outdoor fan motor 105*b* for rotating the outdoor fan 105*a* and a ventilation fan motor (not shown) for rotating the ventilation fan 109, respectively.

The compressor driving unit 520 may drive the compressor 102.

The compressor driving unit 520 may include a rectifier (not shown) that rectifies AC power to DC power and outputs the DC power, a DC terminal capacitor (not shown), a compressor motor 102*b* that drives the compressor 102 according to an inverter (not shown) and/or a three-phase AC power output from the inverter.

The valve unit 530 may include at least one valve. At least one valve included in the valve unit 530 may operate under the control of the controller 550. For example, the valve unit 530 may include a main valve 106, a sub valve 107, a cooling/heating switching valve 110, and/or at least one shut-off valve 111, 112.

The sensor unit 540 may include at least one sensor, and may transmit data on a sensing value detected through at least one sensor to the controller 550.

At least one sensor provided in the sensor unit 540 may be disposed inside the outdoor unit 100, the distribution unit 200, the indoor unit 500, and the like. For example, the sensor unit 540 may include a heat exchanger temperature sensor disposed in the outdoor heat exchanger 104, at least one pressure sensor detecting a pressure of a refrigerant flowing through each pipe, at least one pipe temperature sensor for detecting the temperature of fluid flowing through each pipe, and the like.

The sensor unit 540 may include an indoor temperature sensor that detects an indoor temperature and/or an outdoor temperature sensor that detects an outdoor temperature. For example, the outdoor temperature sensor may be disposed in the outdoor unit 100, and the indoor temperature sensor may be disposed in the indoor unit 500.

The sensor unit 540 may include an internal temperature sensor 130 that detects a temperature inside the housing 101 of the outdoor unit 100.

The controller 550 may be connected to each component provided in the heat pump, and control the overall operation of each component. The controller 550 may transmit/receive data to and from each component provided in the heat pump.

The controller 550 may be provided not only in the outdoor unit 100, but also in the distribution unit 200, a remote control device (not shown) that remotely controls the operation of the heat pump, and the like. For example, the controller 550 may be included in the control circuit module 140 disposed inside the housing of the outdoor unit 100.

The controller 550 may include at least one processor, and may control the overall operation of the heat pump by using the processor included therein. Here, the processor may be a general processor such as a central processing unit (CPU). Obviously, the processor may be a dedicated device such as an ASIC or another hardware-based processor.

The controller 550 may control an operation of the fan driving unit 510. For example, the controller 550 may change the number of rotations of the outdoor fan 105*a* by changing the frequency of the three-phase AC power output to the outdoor fan motor 105*b* through the operation control of the fan driving unit 510.

The controller 550 may control the operation of the compressor driving unit 520. For example, the controller 550 may change the operating frequency of the compressor 102 by changing the frequency of the three-phase AC power output to the compressor motor 102*b* through the operation control of the compressor driving unit 520.

The controller 550 may control an operation of at least one valve included in the valve unit 530 according to the mode of the heat pump. For example, when the heat pump is set to a cooling mode, and when the refrigerant compressed by the compressor 102 moves to the water refrigerant heat exchanger 108 through the outdoor heat exchanger 104 and the heat pump is set to the heating mode, the controller 550 may control the operation of the cooling/heating switching valve 110 so that the refrigerant compressed by the compressor 102 moves to the outdoor heat exchanger 104 through the water refrigerant heat exchanger 108.

The controller 550 may control an operation of each component provided in the heat pump, based on a sensing value of at least one sensor included in the sensor unit 540. For example, the controller 550 may determine whether a refrigerant leaks, based on the sensing value of at least one sensor included in the sensor unit 540, and may control the operation of each configuration provided in the heat pump according to whether the refrigerant leaks.

The controller 550 may determine whether the refrigerant leaks, based on the sensing value of the internal temperature sensor 130 and the sensing value of the outdoor temperature sensor. For example, when the outdoor unit 100 is installed outdoors, the sensing value of the internal temperature sensor 130 and the sensing value of the outdoor temperature sensor are similarly detected within a certain reference. However, when a refrigerant containing propane, isobutene, or the like having a low boiling point leaks, the ambient temperature drops sharply. Therefore, the sensing value of the internal temperature sensor 130 may also be rapidly lowered. In this case, when the sensing value of the internal temperature sensor 130 is lower than the sensing value of the outdoor temperature sensor by a certain reference or more, the controller 550 may determine that the refrigerant leaks. The controller 550 may determine whether the refrigerant leaks, based on the amount of change in the sensing value of the internal temperature sensor 130.

The controller 550 may determine whether the refrigerant leaks, based on a sensing value of a discharge temperature sensor (not shown) that detects the temperature of the refrigerant discharged from the compressor 102. For example, when the sensing value of the discharge temperature sensor is higher than or equal to a preset reference temperature, the controller 550 may determine that the amount of refrigerant circulated is insufficient and may increase the opening degree amount of the main valve 106. At this time, in a state where the opening degree of the main valve 106 is the maximum opening degree, when the sensing value of the discharge temperature sensor (not shown) that detects the temperature of the refrigerant discharged from the compressor 102 is higher than or equal to a preset reference temperature for a certain time, the controller 550 may determine that the refrigerant leaks.

The controller 550 may determine whether the refrigerant leaks, based on the operating frequency and power consumption of the compressor 102. For example, when the amount of refrigerant compressed by the compressor 102 is insufficient, power consumption of the compressor 102 may be significantly lower than when the amount of refrigerant is sufficient due to idle rotation of the compressor motor 102*b*. In this case, when the operating frequency of the compressor 102 is higher than or equal to a certain frequency and the power consumption of the compressor 102 is less than a certain power consumption, the controller 550 may determine that the refrigerant leaks. Here, the certain power consumption may be a value corresponding to a certain frequency.

The controller 550 may determine whether the refrigerant leaks, based on the sensing value of the outdoor temperature sensor and the sensing value of the heat exchanger temperature sensor. For example, in the outdoor heat exchanger 104, heat exchange occurs due to the difference between the outdoor temperature and the temperature of the refrigerant, but when the refrigerant is insufficient, the heat exchange efficiency decreases, and the difference between the outdoor temperature and the temperature of the refrigerant may gradually decrease. In this case, when the difference between the sensing value of the outdoor temperature sensor and the sensing value of the heat exchanger temperature sensor is less than a certain reference value, the controller 550 may determine that the refrigerant leaks.

When it is determined that the refrigerant leaks, the controller 550 may control the operation of at least one valve included in the valve unit 530.

When it is determined that the refrigerant leaks, the controller 550 may close the first shutoff valve 111 so that the refrigerant discharged from the compressor 102 may be blocked from being moved to the outdoor heat exchanger 104 or the water refrigerant heat exchanger 108.

When the first shut-off valve 111 is closed, the controller 550 may check whether the sensing value of a first pressure sensor (not shown) that detects the pressure of the refrigerant flowing between the compressor 102 and the water refrigerant heat exchanger 108 is lower than a preset reference pressure. Here, the first pressure sensor may be disposed in a pipe connecting the cooling/heating switching valve 110 and the water refrigerant heat exchanger 108.

When the sensing value of the first pressure sensor is less than a preset reference pressure, the controller 550 may determine that the refrigerant flowing in each pipe of the outdoor unit 100 moved to the compressor 102 and the accumulator 103 by a certain amount or more, and may close the second shutoff valve 112. In this case, the controller 550 may control the main valve 106 and/or the sub valve 107 to have a minimum opening degree.

When the second shutoff valve 112 is closed, the controller 550 may control the compressor driving unit 520 to stop the operation of the compressor 102. When the second shutoff valve 112 is closed, the controller 550 may control the fan driving unit 510 to drive the ventilation fan motor of the fan driving unit 510 so that the ventilation fan 109 rotates.

Meanwhile, the heat pump may further include an output unit (not shown).

The output unit may include a display device, such as a display, and a light emitting diode (LED), and may display a message related to a refrigerant leakage through the display device.

The output unit may include an audio device such as a speaker, and a buzzer, and may output a warning sound for refrigerant leakage through the audio device.

FIG. 6 is a flowchart illustrating a method of operating a heat pump according to an embodiment of the present disclosure.

Referring to FIG. 6, the heat pump may monitor whether a refrigerant leaks, at operations S610 and S620.

For example, when the sensing value of the internal temperature sensor 130 is lower than the sensing value of the outdoor temperature sensor by a certain reference or more, the heat pump may determine that the refrigerant leaks.

For example, in a state in which the opening degree of the main valve 106 is the maximum opening degree, when the sensing value of the discharge temperature sensor for detecting the temperature of the refrigerant discharged from the compressor 102 is higher than or equal to a preset reference temperature for a certain time, the heat pump may determine that the refrigerant leaks.

For example, the heat pump may determine that the refrigerant leaks, when the operating frequency of the compressor 102 is equal to or higher than a certain frequency, and the power consumption of the compressor 102 is less than a certain power consumption.

For example, when the difference between the sensing value of the outdoor temperature sensor and the sensing value of the heat exchanger temperature sensor is less than a certain reference value, the heat pump may determine that the refrigerant leaks.

At this time, the heat pump may independently perform a plurality of methods of monitoring whether the refrigerant leaks, or may be sequentially performed.

When the refrigerant leaks, the heat pump closes the first shutoff valve 111, thereby blocking the refrigerant discharged from the compressor 102 from moving to the outdoor heat exchanger 104 or the water refrigerant heat exchanger 108, at operation S630.

The heat pump may check whether the sensing value of the first pressure sensor for detecting the pressure of the refrigerant flowing between the compressor 102 and the water refrigerant heat exchanger 108 is lower than a preset reference pressure, in a state in which the first shutoff valve 111 is closed, at operation S640.

When the sensing value of the first pressure sensor is less than a preset reference pressure, the heat pump may determine that the refrigerant flowing in each pipe of the outdoor unit 100 moved to the compressor 102 and the accumulator 103 by a certain amount or more, and may close the second shutoff valve 112, at operation S650.

The heat pump may control the compressor driving unit 520 to stop the operation of the compressor 102, at operation S660.

The heat pump may drive the ventilation fan 109 to discharge the leaked refrigerant together with the air inside the housing 101 to the outside, at operation S670.

As described above, according to various embodiments of the present disclosure, it is possible to accurately determine whether the refrigerant leaks from various angles through various methods by using the sensing value of the internal temperature sensor 130, the sensing value of the discharge temperature sensor, the sensing value of the outdoor temperature sensor, the sensing value of the heat exchanger temperature sensor, the power consumption of the compressor 102, and the like.

In addition, according to various embodiments of the present disclosure, when the refrigerant leaks, the shut-off valves 111 and 112 are closed so that the refrigerant does not leak any more, and the refrigerant can be discharged to the outdoors by driving the ventilation fan 109, thereby reducing the possibility of fire, and improving the safety and reliability of the product.

In addition, according to various embodiments of the present disclosure, even if the refrigerant leaks, it is possible to block refrigerant from entering the room, by disposing the water refrigerant heat exchanger 108 in the outdoor unit 100 so that the refrigerant circulates only inside the housing 101 of the outdoor unit 100.

According to various embodiments of the present disclosure, it is possible to accurately determine whether a refrigerant leaks through various methods using sensors or the like.

In addition, according to various embodiments of the present disclosure, when the refrigerant leaks, the operation of valves is controlled so that the refrigerant does not leak anymore, and the refrigerant can be discharged to the outdoors by driving a ventilation fan, thereby reducing the possibility of fire and improving the safety and reliability of the product.

Since the accompanying drawings are merely for easily understanding embodiments disclosed herein, it should be understood that the technical spirit disclosed herein is not limited by the accompanying drawings, and all changes, equivalents or substitutions are included in the spirit and technical scope of the present disclosure.

Likewise, although operations are shown in a specific order in the drawings, it should not be understood that the operations are performed in the specific order shown in the drawings or in a sequential order so as to obtain desirable results, or all operations shown in the drawings are performed. In certain cases, multitasking and parallel processing may be advantageous.

Although the present disclosure has been described with reference to specific embodiments shown in the drawings, it is apparent to those skilled in the art that the present description is not limited to those exemplary embodiments and is embodied in many forms without departing from the scope of the present disclosure, which is described in the following claims. These modifications should not be individually understood from the technical spirit or scope of the present disclosure.

The invention claimed is:

1. A heat pump, comprising:

a housing configured to be disposed outdoors;

a compressor configured to compress a refrigerant;

a fluid refrigerant heat exchanger configured to perform heat exchange between the refrigerant and a fluid;

an outdoor heat exchanger configured to perform heat exchange between the refrigerant and outdoor air;

a pressure sensor configured to detect a pressure of the refrigerant flowing between the compressor and the fluid refrigerant heat exchanger;

a first shut-off valve disposed in a pipe connected to a discharge outlet of the compressor;

a second shut-off valve disposed between the outdoor heat exchanger and the compressor; and a controller configured to:

determine whether the refrigerant leaks;

control the first shut-off valve to be closed when the refrigerant leaks; and control the second shutoff valve to be closed when the pressure sensed by the pressure sensor is less than a predetermined reference pressure.

2. The heat pump of claim 1, further comprising:

an outdoor fan disposed at one side of the outdoor heat exchanger; and a ventilation fan configured to discharge air inside of the housing to the outside, wherein the controller is configured to stop operation of the compressor and drive the ventilation fan, when the second shutoff valve is closed.

3. The heat pump of claim 2, wherein the outdoor fan is disposed in a first area of the housing, wherein the ventilation fan is disposed in a second area of the housing, and wherein the housing includes a partition wall that separates the first area and the second area from each other.

4. The heat pump of claim 3, wherein the fluid refrigerant heat exchanger is disposed in the second area of the housing.

5. The heat pump of claim 2, further comprising:

a first temperature sensor configured to sense an outdoor temperature; and a second temperature sensor disposed in the housing, wherein the controller is configured to determine that the refrigerant leaks, when a temperature sensed by the second temperature sensor is lower than the outdoor temperature sensed by the first temperature sensor by a predetermined reference amount or more.

6. The heat pump of claim 5, wherein the ventilation fan and the second temperature sensor are disposed adjacent to a bottom surface of the housing.

7. The heat pump of claim 6, wherein a density of the refrigerant is greater than a density of air.

8. The heat pump of claim 6, further comprising:

an expansion valve configured to expand the refrigerant; and a third temperature sensor configured to sense a temperature of the refrigerant discharged from the compressor, wherein the controller is configured to determine that the refrigerant leaks, when the temperature sensed by the third temperature sensor is equal to or higher than a predetermined reference temperature for a predetermined period of time, in a state in which an opening degree of the expansion valve is a maximum opening degree.

9. The heat pump of claim 8, wherein the controller is further configured to:

calculate a power consumption of the compressor; and determine that the refrigerant leaks, when an operating frequency of the compressor is higher than or equal to a predetermined frequency, and the power consumption of the compressor is less than a predetermined power consumption.

10. The heat pump of claim 9, further comprising a fourth temperature sensor configured to sense a temperature of the outdoor heat exchanger, wherein the controller is configured to determine that the refrigerant leaks, when a difference between the outdoor temperature sensed by the first temperature sensor and the temperature sensed by the fourth temperature sensor is less than a predetermined reference value.

11. A method for operating a heat pump, the heat pump comprising: a compressor that compresses refrigerant, an outdoor heat exchanger configured to perform heat exchange between the refrigerant and outdoor air, a fluid-refrigerant heat exchanger configured to perform heat exchange between the refrigerant and a fluid, a first shut off valve disposed in a pipe connected to a discharge outlet of the compressor, and a second shut off valve disposed between the outdoor heat exchanger and the compressor, the method comprising:

detecting via a pressure sensor a pressure of the refrigerant flowing between the fluid-refrigerant heat exchanger and the compressor;

determining a refrigerant leak;

closing the first shut off valve in response to a determination of the refrigerant leak; and closing the second shut off valve in response to the pressure detected by the pressure sensor being less than a predetermined reference pressure.

12. The method of claim 11, further comprising:

stopping operation of the compressor; and in response to the second shut-off valve being closed driving a ventilation fan provided in the heat pump and discharging air inside of a housing disposed outdoors to the outside.

13. The method of claim 12, wherein an outdoor fan disposed at one side of the outdoor heat exchanger is disposed in a first area of the housing of the heat pump, wherein the ventilation fan is disposed in a second area of the housing, and wherein the housing includes a partition wall that separates the first area and the second area from each other.

14. The method of claim 13, wherein the fluid refrigerant heat exchanger is disposed in the second area of the housing.

15. The method of claim 12, wherein the heat pump further comprises a first temperature sensor configured to detect the outdoor temperature, and a second temperature sensor disposed in a second area of the housing, and wherein the determining of the refrigerant leak comprises:

determining a temperature sensed by the second temperature being lower by a predetermined reference amount or more than the first temperature sensor.

16. The method of claim 15, wherein the ventilation fan and the second temperature sensor are disposed adjacent to a bottom surface of the housing.

17. The method of claim 16, wherein a density of the refrigerant is greater than a density of air.

18. The method of claim 17, wherein the heat pump further comprises: an expansion valve configured to expand the refrigerant, and a third temperature sensor configured to detect the temperature of the refrigerant discharged from the compressor, and wherein the determining of the refrigerant leak comprises:

determining a temperature sense by the third temperature sensor being higher than or equal to a predetermined reference temperature for a predetermined period of time, in a state in which an opening degree of an expansion valve is a maximum opening degree.

19. The method of claim 18, wherein the determining of the refrigerant leak comprises: determining an operating frequency of the compressor being higher than or equal to a predetermined frequency, and a power consumption of the compressor being less than a predetermined power consumption.

20. The method of claim 19, wherein the heat pump further comprises a fourth temperature sensor configured to sense the temperature of the outdoor heat exchanger, and wherein the determining of the refrigerant leak comprises: determining a difference between the temperature sensed by the first temperature sensor and a temperature sensed by the fourth temperature sensor being less than a predetermined reference temperature.

* * * * *